US007438199B1

(12) United States Patent
Tidrick

(10) Patent No.: US 7,438,199 B1
(45) Date of Patent: Oct. 21, 2008

(54) VACUUM RELEASE TRASH CONTAINER APPARATUS

(76) Inventor: Andrew P. Tidrick, 7226 Blanco Rd., San Antonio, TX (US) 78216

( * ) Notice: Subject to any disclaimer, the term of this patent is extended or adjusted under 35 U.S.C. 154(b) by 155 days.

(21) Appl. No.: 11/539,562

(22) Filed: Oct. 6, 2006

(51) Int. Cl.
*B65D 25/18* (2006.01)
*B65D 35/14* (2006.01)
*B65D 90/02* (2006.01)

(52) U.S. Cl. ..... 220/495.04; 220/62.18

(58) Field of Classification Search ..... 220/62.18, 220/495.04, 495.06, 676, 908.1
See application file for complete search history.

(56) References Cited

U.S. PATENT DOCUMENTS 5,170,906 A * 12/1992 Kochelek ..... 220/495.06
5,375,732 A * 12/1994 Bowers et al. ..... 220/676
6,102,343 A 8/2000 Grimesey et al.
6,474,495 B1 11/2002 Frei
6,736,281 B2 5/2004 Joseph

* cited by examiner

*Primary Examiner*—Anthony D Stashick
*Assistant Examiner*—Harry A Grosso
(74) *Attorney, Agent, or Firm*—Crossley Patent Law; Mark Ashley Crossley

(57) ABSTRACT

An open-topped, vacuum release trash container apparatus for use with trash container bags, the apparatus comprised of a hollow container comprising a continuous substantially vertical side wall, the side wall having an inner wall and an outer wall, a bottom joined to the side wall, a plurality of substantially vertical spaced apart support ribs, the ribs disposed within the side wall between the inner wall and the outer wall, the ribs thereby defining open columns between the ribs, a lipped rim around a top of the side wall, a plurality of vacuum release orifices in a top of the rim, a plurality of vacuum release orifices in the inner wall, the orifices proximal to the bottom of the container, the orifices in communication with the columns. The apparatus is provided with a variety of foot hold embodiments.

20 Claims, 5 Drawing Sheets

VACUUM RELEASE TRASH CONTAINER APPARATUS

BACKGROUND OF THE INVENTION

Trash bag removal from a trash container is difficult primarily due to the vacuum seal formed between the bag and the container. Lifting a trash-filled bag from the container typically engages a vacuum between the bag and the container bottom and sides. Difficulty is increased for the elderly and the physically impaired when trying to perform the bag lifting movement while combating container lift at the same time. Additionally, even if vacuum is minimal or eliminated, friction between the bag and the container sill inhibits bag removal, as many containers are relatively light weight and simply lift off of the floor along with attempts to lift the bag from within. A lack of sturdiness of most containers can further inhibit the separation of bag and container, as the container is difficult to hold in a non-flexing posture. What is needed is an inexpensive trash container that solves the above problems.

1. Field of the Invention

The vacuum release trash container apparatus relates to trash containers and the like and more especially to a vacuum release trash container that provides vacuum release, rigidity, and foot holds.

2. Description of the Prior Art

There exists a plethora of prior art in the field of trash containers. Each provides unique features, although none provide the unique and combined features of the present apparatus. Prior related art U.S. Pat. No. 6,102,343 to Grimesey et al. Aug. 15, 2000 teaches a step and lift refuse liner removal system. The system provides a moving support plate within with lifting assembly for the support plate. The system is far more complex than the current apparatus, and further, cannot offer the inexpensive problems of the current apparatus. U.S. Pat. No. 6,474,495 to Frei Nov. 5, 2002 teaches a garbage can and method therefor which provides a garbage can defining apertures around an open end and a closed end in order to maintain equilibrium of air pressure within the receptacle so avoid the suction-cup effect when inserting and removing a garbage bag. The device does not offer the combined problem solutions provided by the current apparatus, namely, vacuum release, sturdiness, and foot holds. U.S. Pat. No. 6,736,281B2 to Joseph May 18, 2004 teaches a vacuum-release waste receptacle offered in a variety of different configurations of the air baffles. The devices does not offer the combined problem solutions of the present apparatus.

While the above-described devices fulfill their respective and particular objects and requirements, they do not describe a vacuum release trash container apparatus that provides for the advantages of the vacuum release trash container apparatus. In tis respect, the vacuum release trash container apparatus substantially departs from the conventional concepts and designs of the prior art. Therefore, a need exists for an improved vacuum release trash container apparatus.

SUMMARY OF THE INVENTION

The general purpose of the vacuum release trash container apparatus, described subsequently in greater detail, is to provide a vacuum release trash container apparatus which has many novel features that result in an improved vacuum release trash container apparatus which is not anticipated, rendered obvious, suggested, or even implied by prior art, either alone or in combination thereof.

To attain this, the vacuum release trash container apparatus comprises a rigid yet light weight container for trash bags. The basic design of the apparatus provides for various shapes without undue expense. The features of the apparatus are easily provided in circular, triangular, rectangular, and other shapes, without the need for significant redesign of the apparatus. The support ribs provide not only for support against container distortion, but also columns for air passage between the ribs. The plurality of vacuum release orifices provides for better function than do a limited number of orifices. By providing orifices that substantially surround the container, top and bottom, no area of the inside of the container is subject to vacuum formation. The ribs provide additional support with very slight weight increase for the container. Further, the apparatus is not limited with respect to the number of foot holds provided. One embodiment provides a foot hold that encircles the entire bottom periphery of the apparatus.

Another embodiment of the apparatus provides for a continuous foot hold that surrounds the bottom of the container apparatus. The continuous foot hold provides for temporary anchoring of the apparatus without having to access a particular foot hold spot on the bottom of the side walls. This embodiment provides orifices throughout the interior hold boundary to insure against vacuum retention of trash bags upon removal.

The lip of the rim meets two objects of the apparatus. The first object met by the lip extending beyond the rim is to provide a temporary catch edge for typically used bags that are fitted within the container. The second object of the lip is to provide further reinforcement of the container.

While various embodiments of the apparatus are provided with differing height configurations of the ribs, the preferred embodiment comprises ribs which are continuous through the height of the container apparatus, the ribs joining the rim and the bottom of the container apparatus.

Thus has been broadly outlined the more important features of the improved vacuum release trash container apparatus so that the detailed description thereof that follows may be better understood and in order that the present contribution to the art may be better appreciated.

An object of the vacuum release trash container apparatus is to provide for release form the vacuum attraction of a bag to the container.

Another object of the vacuum release trash container apparatus is to provide rigidity.

A further object of the vacuum release trash container apparatus is to provide light weight.

An added object of the vacuum release trash container apparatus is to provide an inexpensive apparatus.

And, an object of the vacuum release trash container apparatus is to provide a design that can be produced in a variety of shapes without undue expense or design change.

A yet further object of the vacuum release trash can apparatus is to provide for foot holds for holding the apparatus down when removing and inserting a trash bag.

Still a further object of the vacuum release trach can apparatus is to provide a lip on the top rim for better trash bag retention.

These together with additional objects, features and advantages of the improved vacuum release trash container apparatus will be readily apparent to those of ordinary skill in the art upon reading the following detailed description of presently preferred, but nonetheless illustrative, embodiments of the improved vacuum release trash container apparatus when taken in conjunction with the accompanying drawings.

In this respect, before explaining the current embodiments of the improved vacuum release trash container apparatus in detail, it is to be understood that the vacuum release trash container apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved vacuum release trash container apparatus. It is therefore important that the claims be regarded as including such equivalent constructions insofar as they do not depart form the spirit and scope of the vacuum release trash container apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 5 thereof, the principles and concepts of the vacuum release trash container apparatus generally designated by the reference number 10 will be described.

Figure 1:
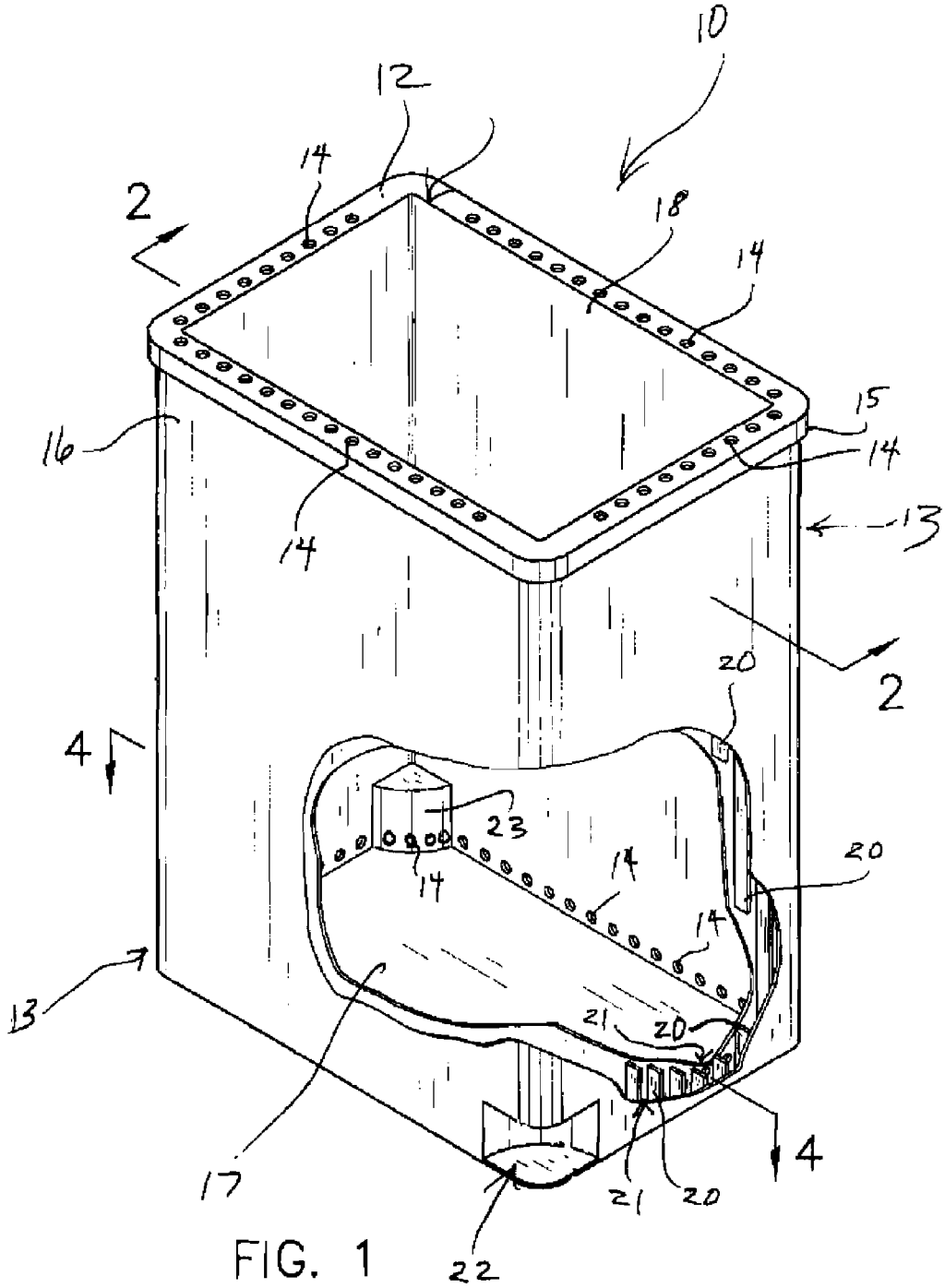
FIG. 1 is a perspective view including a partial cross section.
Figure 2:
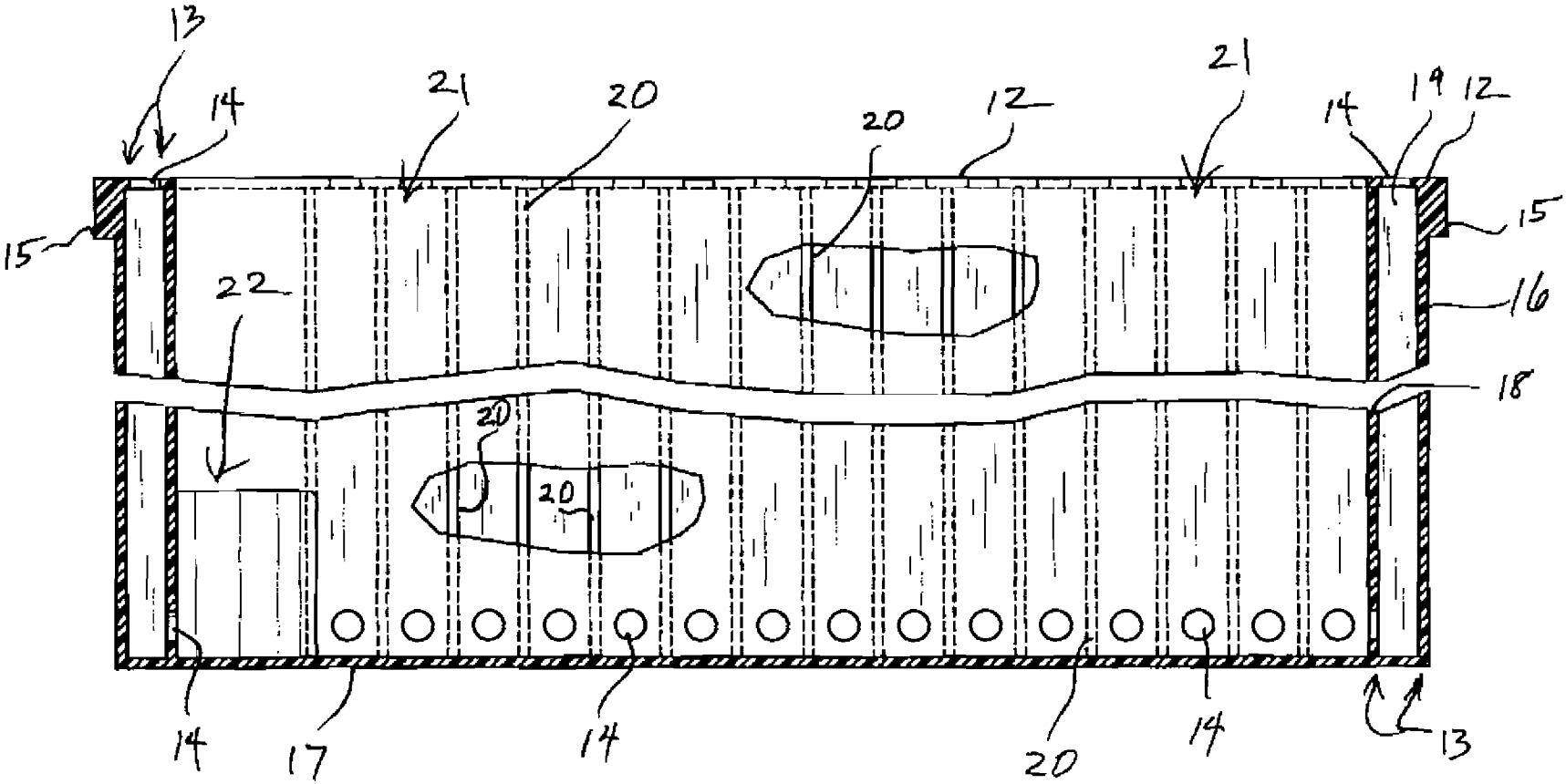
FIG. 2 is a cross sectional view of FIG. 1.

Referring to FIGS. 1 and 2, the vacuum release trash container apparatus 10 is for use with trash container bags. The apparatus 10 is comprised of a hollow container comprising a continuous substantially vertical side wall 13. The side wall 13 defines a shape. The shape illustrated is rectangular; however, the apparatus 10 is not confined to rectangular. The continuous side wall 13 construction of the apparatus 10 provides for shapes such as but not limited to rectangular, trapezoidal, circular, octagonal, hexagonal, and the like. The side wall 13 has an inner wall 18 and an outer wall 16. The bottom 17 is joined to the side wall 13. A plurality of substantially vertical spaced apart support ribs 20 is provided. The ribs 20 are disposed within the side wall 13 between the inner wall 18 and the outer wall 16. The ribs 20 are preferably perpendicular to the inner wall 18 and outer wall 16. The ribs 20 thereby define open columns 21 between the ribs 20. The container apparatus 10 is provided in open-topped configuration. The rim 12 is disposed around the top of the side wall 13. A plurality of vacuum release orifices 14 is disposed in the top of the rim 12. The orifices 14 are in communication with the columns 21. A plurality of vacuum release orifices 14 is disposed in the inner wall 18 proximal to the bottom 17 of the container apparatus 10. The orifices 14 are in communication with the columns 21 such that air freely passes from both the rim 12 orifices 14 and the inner wall 18 orifices 14. More than one foot hold 22 is indented into the side wall 13. Each foot hold 22 is proximal to the bottom 17 of the container apparatus 10.

Figure 3:
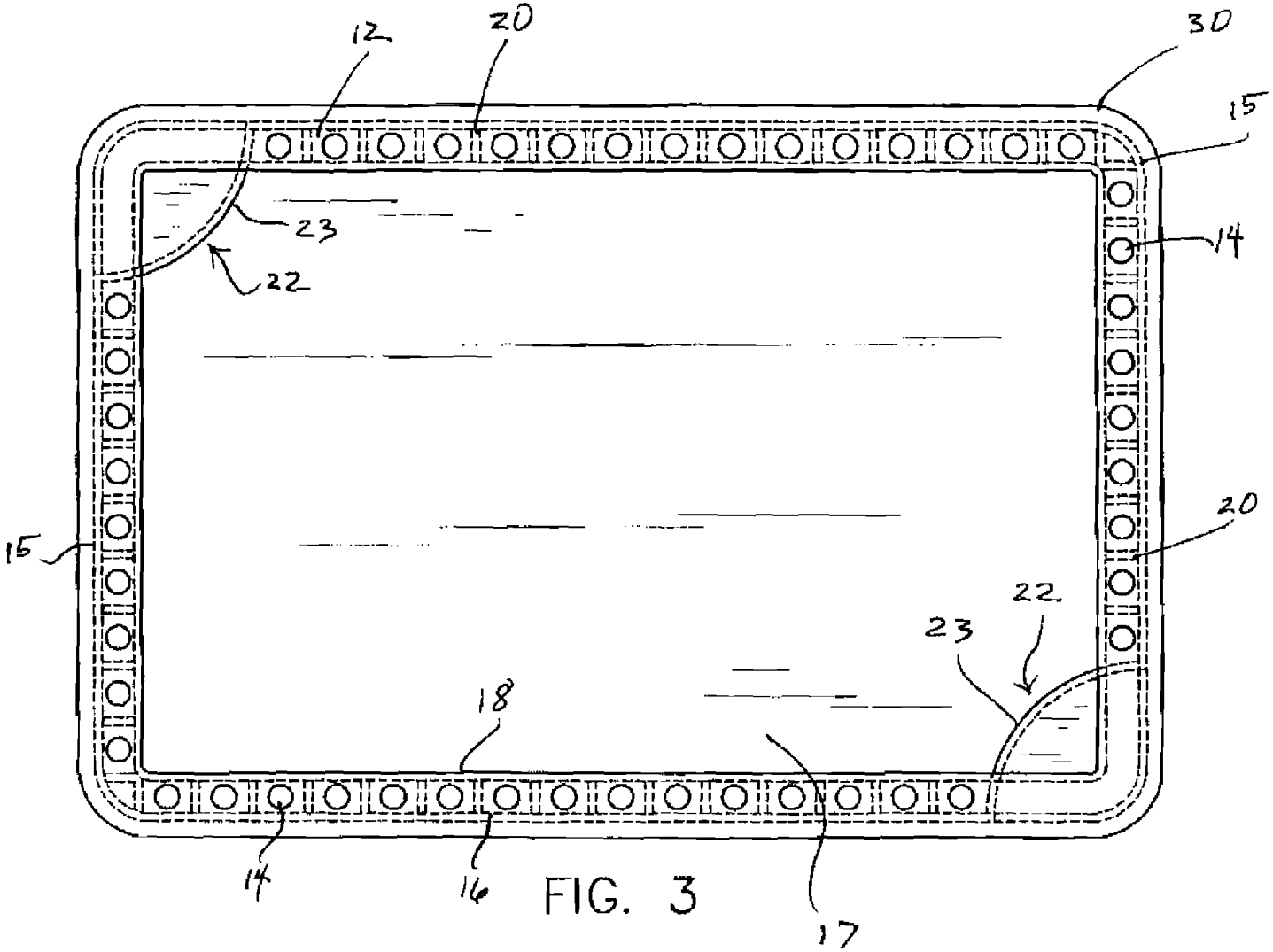
FIG. 3 is a top plan view of FIG. 1, with lid.
Figure 4:
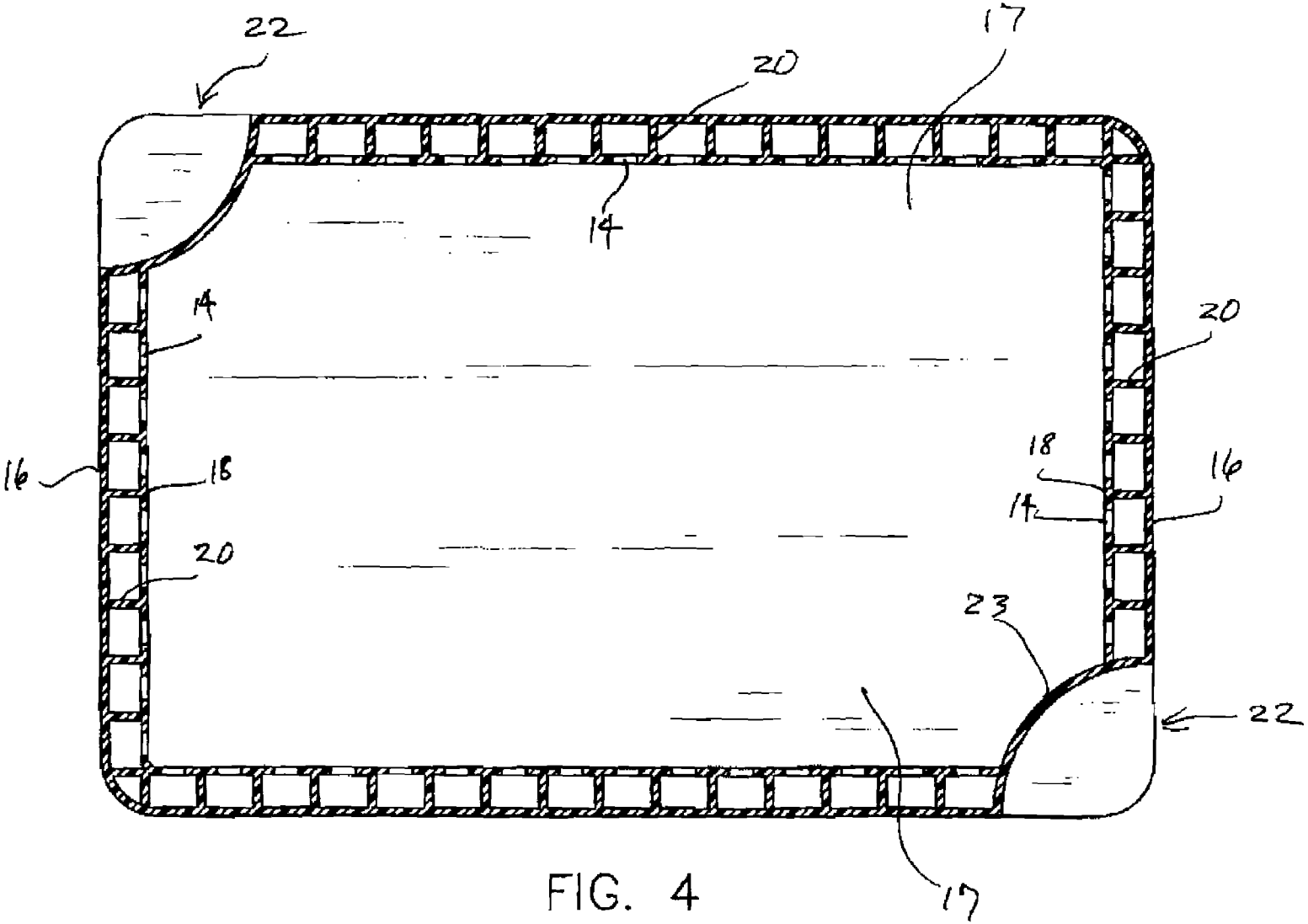
FIG. 4 is a partial cross sectional view of FIG. 1.
Figure 5:
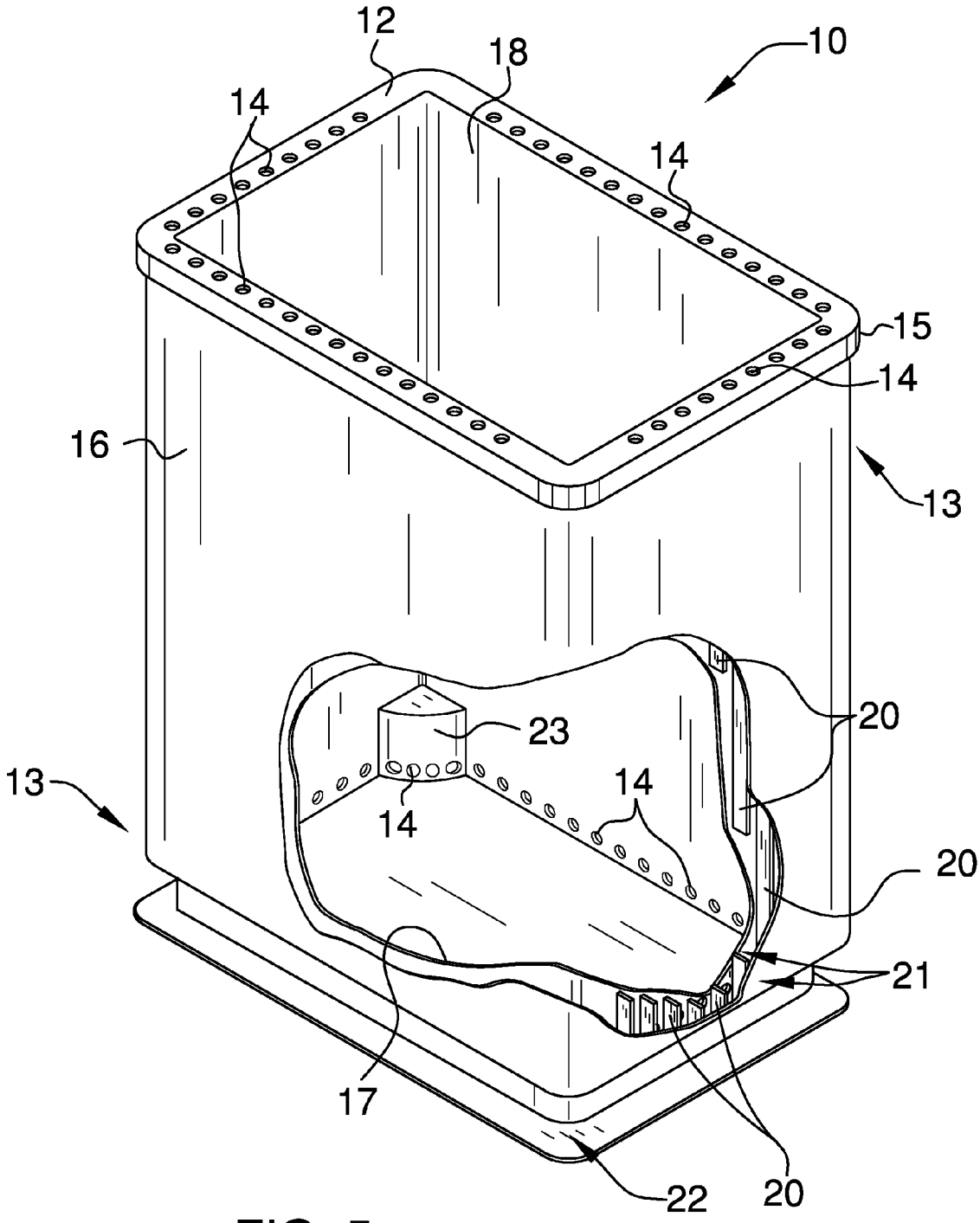
FIG. 5 is a perspective view with a partial cutaway illustrating a continuous foot hold indented into a side wall.

Referring to FIGS. 3 and 4, the ribs 20 are illustrated in their preferred embodiment. The ribs 20 are joined to the lip rim 12 of the container apparatus 10. The ribs 20 are preferably joined to the bottom 17 of the container apparatus 10. The ribs 20 are thereby continuous within the side wall 13 of the container apparatus 10. The ribs 20 are disposed perpendicularly with respect to the surfaces of the inner wall 18 and outer wall 16. The open columns 21 between the ribs 20 and the inner wall 18 and outer wall 16 are bounded upwardly by the vacuum release orifices 14 and proximal to the bottom 17 by vacuum release orifices 14. The ribs 20 add strength to the apparatus 10 without sacrificing the apparatus 10 to substantial weight gain. The rim 12 of the side wall 13 further comprises a lip 15. The lip 15 is disposed around the periphery of the rim 12. The lip 15 extends horizontally outward form the side wall 13 outer wall 16. The lip 15 provides a means for temporarily holding a trash bag top.

The apparatus 10 optionally includes food holds 22 which comprise vacuum release orifices 14 as illustrated. The orifices 14 provide communication with the inner wall 18 and the open columns 21.

While the foot holds 22 illustrated are limited to two, other embodiments of the apparatus 10 provide for more numerous foot holds 22. Yet another embodiment of the apparatus 10 provides a continuous foot hold 22 that circumscribes the sidewall 13 of the container apparatus 10. This described embodiment provides vacuum release orifices 14 throughout the inner hold boundary 23.

With respect to the above description then, it is to be realized that the optimum dimensional relationships for the parts of the vacuum release trash container apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the vacuum release trash container apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the vacuum release trash container apparatus may be used.

Therefore, the foregoing is considered as illustrative only of the principles of the vacuum release trash container apparatus. Further, since numerous modifications and changes will readily occur to those skilled in the art, it is not desired to limit the vacuum release trash container apparatus to the exact construction and operation shown and described, and accordingly, all suitable modifications and equivalents may be restored to, falling within the scope of the vacuum release trash container apparatus.

What is claimed is:

1. A vacuum release trash container apparatus for use with trash container bags, the apparatus comprised of a hollow container comprising:

a continuous substantially vertical side wall, the side wall defining a shape, the side wall having an inner wall and an outer wall;

a bottom joined to the side wall;

a plurality of substantially vertical spaced apart support ribs, the ribs disposed within the side wall between the inner wall and the outer wall, the ribs thereby defining open columns between the ribs;

an open top of the container;

a rim around a top of the side wall;

a plurality of vacuum release orifices in a top of the rim, the orifices in communication with the columns;

a plurality of vacuum release orifices in the inner wall, the orifices proximal to the bottom of the container, the orifices in communication with the columns;

more than one foot hold indented into the side wall, each foot hold proximal to the bottom of the container.

2. The apparatus in claim 1 wherein the ribs are joined to the rim of the container.

3. The apparatus in claim 1 wherein the ribs are joined to the bottom of the container.

4. The apparatus in claim 2 wherein thee ribs are joined to the bottom of the container.

5. The apparatus in claim 1 wherein the foot holds comprise vacuum release orifices, the orifices in communication with the inner wall.

6. The apparatus in claim 1 wherein the rim further comprises a lip around a periphery of the rim, the lip extended horizontally outward from the side wall outer wall.

7. The apparatus in claim 2 wherein the rim further comprises a lip around a periphery of the rim, the lip extended horizontally outward from the side wall outer wall.

8. The apparatus in claim 3 wherein the rim further comprises a lip around a periphery of the rim, the lip extended horizontally outward from the side wall outer wall.

9. The apparatus in claim 4 wherein the rim further comprises a lip around a periphery of the rim, the lip extended horizontally outward from the side wall outer wall.

10. The apparatus in claim 5 wherein the rim further comprises a lip around a periphery of the rim, the lip extended horizontally outward from the side wall outer wall.

11. A vacuum release trash container apparatus for use with trash container bags, the apparatus comprised of a hollow container comprising:

a continuous substantially vertical side wall, the side wall defining a shape, the side wall having an inner wall and an outer wall;

a bottom joined to the side wall;

a plurality of substantially vertical spaced apart support ribs, the ribs disposed within the side wall between the inner wall and the outer wall, the ribs thereby defining open columns between the ribs;

an open top;

a rim around a top of the side walls;

a plurality of vacuum release orifices in a top of the rim, the orifices in communication with the columns;

a continuous foot hold indented into the side wall, the foot hold proximal to the bottom of the container, the foot hold having in interior hold boundary;

a plurality of vacuum release orifices in the interior hold boundary, the orifices in communication with the columns.

12. The apparatus in claim 11 wherein the ribs are joined to the rim of the container.

13. The apparatus in claim 11 wherein the ribs are joined to the bottom of the container.

14. The apparatus in claim 12 wherein the ribs are joined to the bottom of the container.

15. The apparatus in claim 11 wherein the foot holds comprise vacuum release orifices, the orifices in communication with the inner wall.

16. The apparatus in claim 11 wherein the rim further comprises a lip around a periphery of the rim, the lip extended horizontally outward from the side wall outer wall.

17. The apparatus in claim 12 wherein the rim further comprises a lip around a periphery of the rim, the lip extended horizontally outward form the side wall outer wall.

18. The apparatus in claim 13 wherein the rim further comprises a lip around a periphery of the rim, the lip extended horizontally outward from the side wall outer wall.

19. The apparatus in claim 14 wherein the rim further comprises a lip around a periphery of the rim, the lip extended horizontally outward from the side wall outer wall.

20. The apparatus in claim 15 wherein the rim further comprises a lip around a periphery of the rim, the lip extended horizontally outward from the side wall outer wall.

* * * * *